US010249259B2

(12) United States Patent
Lu et al.

(10) Patent No.: US 10,249,259 B2
(45) Date of Patent: Apr. 2, 2019

(54) METHOD FOR DRIVING A PIXEL ARRAY

(71) Applicants: Boe Technology Group Co., Ltd., Beijing (CN); Beijing Boe Optoelectronics Technology Co.., Ltd., Beijing (CN)

(72) Inventors: Pengcheng Lu, Beijing (CN); Mubing Li, Beijing (CN); Xue Dong, Beijing (CN); Renwei Guo, Beijing (CN)

(73) Assignees: BOE TECHNOLOGY GROUP CO., LTD., Beijing (CN); BEIJING BOE OPTOELECTRONICS TECHNOLOGY CO., LTD., Beijing (CN)

( * ) Notice: Subject to any disclaimer, the term of this patent is extended or adjusted under 35 U.S.C. 154(b) by 37 days.

(21) Appl. No.: 14/778,694

(22) PCT Filed: Apr. 10, 2015

(86) PCT No.: PCT/CN2015/076268
§ 371 (c)(1),
(2) Date: Sep. 21, 2015

(87) PCT Pub. No.: WO2016/065849
PCT Pub. Date: May 6, 2016

(65) Prior Publication Data

US 2016/0329026 A1 Nov. 10, 2016

(30) Foreign Application Priority Data

Oct. 31, 2014 (CN) ..... 2014 1 0602640

(51) Int. Cl.
*G09G 5/04* (2006.01)
*G09G 5/02* (2006.01)
(Continued)

(52) U.S. Cl.
CPC ..... *G09G 5/02* (2013.01); *G09G 3/20* (2013.01); *G09G 3/2003* (2013.01); *G09G 5/10* (2013.01);
(Continued)

(58) Field of Classification Search
None
See application file for complete search history.

(56) References Cited

U.S. PATENT DOCUMENTS 7,889,215 B2 2/2011 Brown Elliott et al.
2002/0093521 A1* 7/2002 Daly ..... G09G 3/2003 345/698
(Continued)

FOREIGN PATENT DOCUMENTS

CN 103714751 A 4/2014
CN 103777393 5/2014
(Continued)

OTHER PUBLICATIONS

Office action from Chinese Application No. 201410602640.x dated May 19, 2016.
(Continued)

*Primary Examiner* — Jennifer Mehmood
*Assistant Examiner* — Parul H Gupta
(74) *Attorney, Agent, or Firm* — Calfee, Halter & Griswold LLP

(57) ABSTRACT

Embodiments of the present invention provide a method for driving a pixel array. The pixel array comprises a plurality of pixel units, each comprising a plurality of sub-pixels of different colors, each sub-pixel having an aspect ratio from 1:2 to 1:1. The method comprises steps of: dividing an image to be displayed on the pixel array into a plurality of theoretical pixel units, each theoretical pixel unit comprising a plurality of color components; and calculating a luminance
(Continued)

value of each sub-pixel of each pixel-unit based on the color components of respective divided theoretical pixel units.

10 Claims, 3 Drawing Sheets

(51) Int. Cl.
*G09G 3/20* (2006.01)
*G09G 5/10* (2006.01)
*G09G 5/14* (2006.01)

(52) U.S. Cl.
CPC ..... *G09G 5/14* (2013.01); *G09G 2300/0452* (2013.01); *G09G 2300/0465* (2013.01); *G09G 2320/0257* (2013.01); *G09G 2320/0626* (2013.01); *G09G 2340/0407* (2013.01); *G09G 2340/0457* (2013.01)

(56) References Cited

U.S. PATENT DOCUMENTS

2002/0140655 A1 10/2002 Liang et al.
2006/0158466 A1* 7/2006 Chien ..... G09G 3/2074 345/694
2006/0170712 A1* 8/2006 Miller ..... H01L 27/3211 345/695
2010/0045695 A1 2/2010 Brown Elliott et al.
2010/0315319 A1* 12/2010 Cok ..... G09G 3/20 345/77

FOREIGN PATENT DOCUMENTS

| | | |
|---|---|---|
| CN | 103824520 A | 5/2014 |
| CN | 103886808 | 6/2014 |
| CN | 103886825 | 6/2014 |
| CN | 103903549 | 7/2014 |
| CN | 104299561 | 1/2015 |
| EP | 2040476 | 3/2009 |
| JP | 2004152737 | 5/2004 |
| JP | 2008282187 | 11/2008 |
| WO | 2015090030 | 6/2015 |

OTHER PUBLICATIONS

International Search Report and Written Opinion from PCT/CN2015/076268 dated Jul. 17, 2015.
Office Action in corresponding CN Application No. 2016051601507280 (dated May 19, 2016).
Office action from Korean Application No. 10-2015-0725878 dated Jul. 20, 2016.
Notice of Allowance from Korean Intellectual Property Office Issue No. 9-5-2017-006939630 dated Jan. 26, 2017.
Search Report from European Patent Application No. 15763180.5 dated May 25, 2018.

* cited by examiner

图 4a

图 4b

图 4c $$\begin{bmatrix} 0.57 & 0.06 \\ 0.37 & 0 \end{bmatrix}$$

F1

$$\begin{bmatrix} 0.24 & 0.56 & 0.06 \\ 0 & 0.14 & 0 \end{bmatrix}$$

F2

$$\begin{bmatrix} 0.01 & 0.12 & 0 \\ 0.21 & 0.48 & 0.05 \\ 0.01 & 0.12 & 0 \end{bmatrix}$$

F3

$$\begin{bmatrix} 0.15 & 0 \\ 0.63 & 0.07 \\ 0.15 & 0 \end{bmatrix}$$

F4

$$\begin{bmatrix} 0 & 0.13 \\ 0.22 & 0.52 \\ 0 & 0.13 \end{bmatrix}$$

F5

$$\begin{bmatrix} 0 & 0.14 & 0 \\ 0.24 & 0.56 & 0.06 \end{bmatrix}$$

F6

$$\begin{bmatrix} 0 & 0.14 \\ 0.25 & 0.61 \end{bmatrix}$$

F7

METHOD FOR DRIVING A PIXEL ARRAY

RELATED APPLICATIONS

The present application is the U.S. national phase entry of PCT/CN2015/76268, filed on Apr. 10, 2015, which claims the benefit of Chinese Patent Application No. 201410602640.X, filed Oct. 31, 2014, the entire disclosures of which are incorporated herein by reference.

FIELD OF THE INVENTION

The present invention relates to the field of display technology, particularly relates to a method for driving a pixel array.

BACKGROUND OF THE INVENTION

In a conventional display panel, a common pixel design includes a pixel unit having three sub-pixels (e.g., a red sub-pixel, a green sub-pixel and a blue sub-pixel, as shown in FIG. 1) or four sub-pixels (e.g., a red sub-pixel, a green sub-pixel, a blue sub-pixel and a white sub-pixel) for display, with the physical resolution being namely the visual resolution.

If the pixel per inch (PPI) of the display panel is relatively low, the user will view the display screen as being grainy (i.e., the edge of the displayed image is not smooth, producing a staircase or "jaggies" effect). With the increase of the user's requirement on viewing perception to the display screen, the PPI of the display panel has to be increased. The increase of the PPI of the display panel will result in process difficulty of manufacturing the display panel.

A technical problem in the art, therefore, is to reduce the graininess of the display panel so as to achieve a display effect of a display panel with a higher resolution under the same size without increasing the manufacturing process difficulty (i.e., not increasing the PPI).

SUMMARY OF THE INVENTION

The technical problems to be solved by the present invention includes: with respect to the problem about the existing pixel array, providing a method for driving a pixel array which is used for driving the pixel array to reduce the graininess of the display panel, so as to achieve a display effect of a display panel with a higher resolution under the same size.

According to an aspect of the present invention, there is provided a method for driving a pixel array, the pixel array comprising a plurality of pixel units, each pixel unit comprising a plurality of sub-pixels of different colors, each sub-pixel having an aspect ratio from 1:2 to 1:1, the method comprising steps of: dividing an image to be displayed on the pixel array into a plurality of theoretical pixel units, each theoretical pixel unit comprising a plurality of color components; and calculating a luminance value of each sub-pixel of each pixel-unit based on the color components of respective divided theoretical pixel units. The step of calculating a luminance value of each sub-pixel comprises sub-steps of: dividing a diamond sampling area for each sub-pixel, a center of the diamond sampling area being a center of the sub-pixel, and four vertexes of the diamond sampling area being midpoints of connecting lines between centers of adjacent sub-pixels in the same row or the same column and with the same color as the sub-pixel and the center of the sub-pixel respectively; calculating a ratio of an overlapping area of each theoretical pixel unit with the diamond sampling area for the sub-pixel and the area of the diamond sampling area, as an area ratio of the theoretical pixel unit with respect to the diamond sampling area for the sub-pixel; and using an area ratio of each theoretical pixel unit with respect to the diamond sampling area for the sub-pixel to multiply a color component of the theoretical pixel unit with the same color as the sub-pixel, and taking a summation of respective products to set the luminance value of the sub-pixel.

According to an embodiment of the present invention, the pixel unit may comprise three sub-pixels of different colors, with each sub-pixel having an aspect ratio of 2:3.

Further, according to an embodiment of the invention, each theoretical pixel unit of the plurality of theoretical pixel units has an aspect ratio of 1:1.

In this embodiment, the three sub-pixels of different colors can be a red sub-pixel, a green sub-pixel and a blue sub-pixel respectively.

According to an embodiment of the present invention, the pixel array may comprise a plurality of pixel groups, each pixel group comprising two adjacent pixel units located in a same column, with left borders of sub-pixels of a next row of pixel unit being aligned with midpoints of lower borders of sub-pixels of a previous row of pixel unit, or left borders of sub-pixels of a previous row of pixel unit being aligned with midpoints of upper borders of sub-pixels of a next row of pixel unit.

According to an embodiment of the present invention, the pixel groups may be arranged in one or more of the following arrangement manners: the sub-pixels of the previous row of pixel unit being a red sub-pixel, a blue sub-pixel and a green sub-pixel, the sub-pixels of the next row of pixel unit being a green sub-pixel, a red sub-pixel and a blue sub-pixel, and the left borders of the sub-pixels of the next row of pixel unit being aligned with the midpoints of the lower borders of the sub-pixels of the previous row of pixel unit; the sub-pixels of the previous row of pixel unit being a blue sub-pixel, a red sub-pixel, a green sub-pixel, the sub-pixel of the next row of pixel unit being a green sub-pixel, a blue sub-pixel and a red sub-pixel, and the left borders of the sub-pixels of the next row of pixel unit being aligned with the midpoints of the lower borders of the sub-pixels of the previous row of pixel unit; the sub-pixels of the previous row of pixel unit being a blue sub-pixel, a green sub-pixel and a red sub-pixel, the sub-pixels of the next row of pixel unit being a red sub-pixel, a blue sub-pixel and a green sub-pixel, and the left borders of the sub-pixels of the next row of pixel unit being aligned with the midpoints of the lower borders of the sub-pixels of the previous row of pixel unit; the sub-pixels of the previous row of pixel unit being a green sub-pixel, a blue sub-pixel and a red sub-pixel, the sub-pixels of the next row of pixel unit being a red sub-pixel, a green sub-pixel and a blue sub-pixel, and the left borders of the sub-pixels of the next row of pixel unit being aligned with the midpoints of the lower borders of the sub-pixels of the previous row of pixel unit; the sub-pixels of the previous row of pixel unit being a green sub-pixel, a red sub-pixel and a blue sub-pixel, the sub-pixel of the next row of pixel unit being a blue sub-pixel, a green sub-pixel and a red sub-pixel, and the left borders of the sub-pixels of the next row of pixel unit being aligned with the midpoints of the lower borders of the sub-pixels of the previous row of pixel unit; the sub-pixels of the previous row of pixel unit being a red sub-pixel, a green sub-pixel and a blue sub-pixel, the sub-pixels of the next row of pixel unit being a blue sub-pixel, a red sub-pixel and a green sub-pixel, and the left borders of the sub-pixels of the next row of pixel unit being aligned with the midpoints of the lower borders of the sub-pixels of the previous row of pixel unit; the sub-pixels of the previous row of pixel unit being a green sub-pixel, a red sub-pixel and a blue sub-pixel, the sub-pixels of the next row of pixel unit being a red sub-pixel, a blue sub-pixel and a green sub-pixel, and the left borders of the sub-pixels of the previous row of pixel unit being aligned with the midpoints of the upper borders of the sub-pixels of the next row of pixel unit; the sub-pixels of the previous row of pixel unit being a green sub-pixel, a blue sub-pixel and a red sub-pixel, the sub-pixels of the next row of pixel unit being a blue sub-pixel, a red sub-pixel and a green sub-pixel, and the left borders of the sub-pixels of the previous row of pixel unit being aligned with the midpoints of the upper borders of the sub-pixels of the next row of pixel unit; the sub-pixels of the previous row of pixel unit being a red sub-pixel, a blue sub-pixel and a green sub-pixel, the sub-pixels of the next row of pixel unit being a blue sub-pixel, a green sub-pixel and a red sub-pixel, and the left borders of the sub-pixels of the previous row of pixel unit being aligned with the midpoints of the upper borders of the sub-pixels of the next row of pixel unit; the sub-pixels of the previous row of pixel unit being a red sub-pixel, a green sub-pixel and a blue sub-pixel, the sub-pixels of the next row of pixel unit being a green sub-pixel, a blue sub-pixel and a red sub-pixel, and the left borders of the sub-pixels of the previous row of pixel unit being aligned with the midpoints of the upper borders of the sub-pixels of the next row of pixel unit; the sub-pixels of the previous row of pixel unit being a blue sub-pixel, a green sub-pixel and a red sub-pixel, the sub-pixels of the next row of pixel unit being a green sub-pixel, a red sub-pixel and a blue sub-pixel, and the left borders of the sub-pixels of the previous row of pixel unit being aligned with the midpoints of the upper borders of the sub-pixels of the next row of pixel unit; or the sub-pixels of the previous row of pixel unit being a blue sub-pixel, a red sub-pixel and a green sub-pixel, the sub-pixels of the next row of pixel unit being a red sub-pixel, a green sub-pixel and a blue sub-pixel, and the left borders of the sub-pixels of the previous row of pixel unit being aligned with the midpoints of the upper borders of the sub-pixels of the next row of pixel unit.

According to an embodiment of the present invention, each sub-pixel may have an aspect ratio of 1:2.

According to an embodiment of the present invention, each sub-pixel may have an aspect ratio of 1:1.

According to another embodiment of the present invention, the pixel unit may comprise four sub-pixels of different colors.

Further, said four sub-pixels can be a red sub-pixel, a green sub-pixel, a blue sub-pixel and a white sub-pixel respectively.

BRIEF DESCRIPTION OF THE DRAWINGS

The drawings are used for providing further understanding to the present invention, and constitute a part of the description for explaining the present invention together with the following embodiments, however, they are not intended to limit the present invention, in which.

FIGS. 4*a* to 4*f* are schematic views of pixel units in a pixel array according to a further embodiment of the present invention;

DETAILED DESCRIPTION OF THE INVENTION

In order to enable the skilled person in the art to understand the technical solution of the present invention better, embodiments of the present invention will be described in more details next with reference to the drawings.

Figure 1:
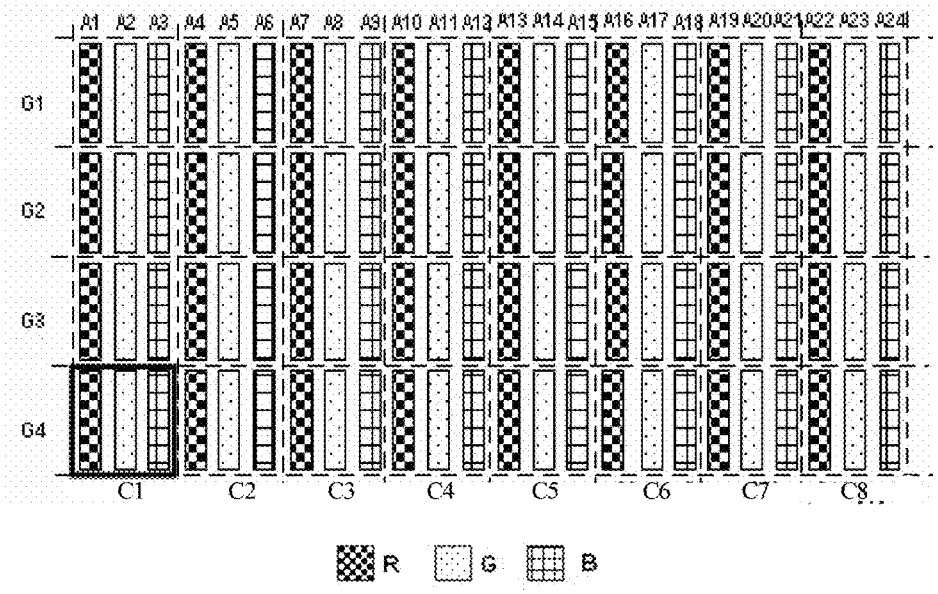
FIG. 1 is a schematic view of an existing pixel array, meanwhile, it shows a dividing manner of a theoretical pixel unit.
Figure 2A:
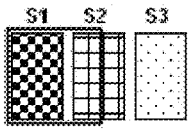
FIGS. 2*a* to 2*d* are schematic views of pixel units in a pixel array according to an embodiment of the present invention.
Figure 2B:
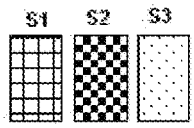
Figure 2C:
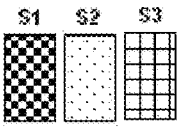
Figure 2D:
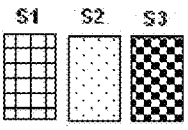

In the existing pixel array as shown in FIG. 1, each sub-pixel has an aspect ratio of 1:3, compared with the prior art, the sub-pixel in the pixel array provided by an embodiment of the present invention has a relatively large width, hence, it is convenient for processing and manufacturing. In addition, compared with the prior art, in the pixel array provided by the embodiment of present invention, the number of the lateral sub-pixels is reduced, so that the number of the data lines required by the pixel array is reduced, thereby further simplifying the manufacturing process of the pixel array.

When the pixel array is driven using the method provided by embodiments of the present invention, the graininess of the display panel comprising the pixel array can be reduced, so as to achieve the display effect of the display panel with a higher resolution under the same size. It is easy for the skilled person in the art to understand that the three sub-pixels of different colors in each pixel unit, for example, can be a red sub-pixel R, a green sub-pixel G and a blue sub-pixel B. In the present invention, the colors in each pixel units and the arrangement sequence of the respective sub-pixels of different colors are not limited.

Figure 5:
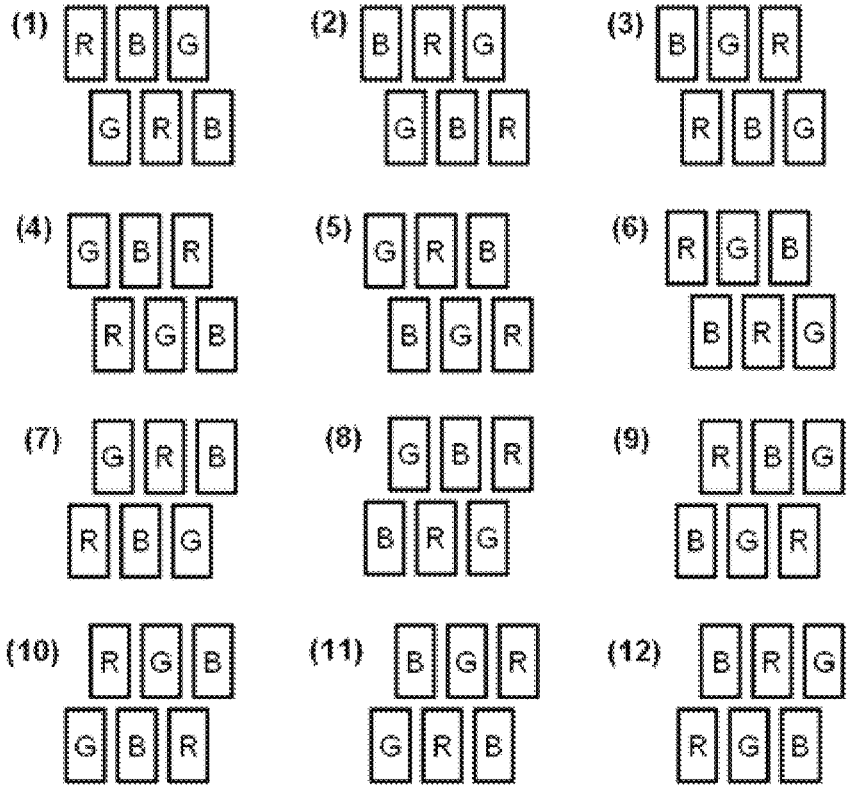
FIG. 5 is a schematic view of pixel groups in a pixel array according to an embodiment of the present invention.

According to an embodiment of the present invention, as shown in FIG. 2*a* to FIG. 2*d*, each pixel unit in the pixel array comprises three sub-pixels of different colors, each sub-pixel having an aspect ratio of 2:3. In addition, the pixel array may comprise a plurality of pixel groups, each pixel group comprising two adjacent pixel units located in a same column. The left borders of the sub-pixels of a row of pixel units can be aligned with the midpoints of the lower borders of the sub-pixels of the previous row of pixel units. Alternatively, the left borders of the sub-pixels of a row of pixel units can be aligned with the midpoints of the upper borders of the sub-pixels of the next row of pixel units. FIG. 5 shows different arrangement manners of the pixel groups.

As shown in FIG. 5, the pixel groups can be arranged in one or more of the following arrangement manners. In embodiment (1), the sub-pixels of the previous row of pixel unit, from left to right, are a red sub-pixel, a blue sub-pixel and a green sub-pixel, the sub-pixels of the next row of pixel unit, from left to right, are a green sub-pixel, a red sub-pixel and a blue sub-pixel, and the left borders of the sub-pixels of the next row of pixel unit are aligned with the midpoints of the lower borders of the sub-pixels of the previous row of pixel unit. In embodiment (2), the sub-pixels of the previous row of pixel unit, from left to right, are a blue sub-pixel, a red sub-pixel, a green sub-pixel, the sub-pixels of the next row of pixel unit, from left to right, are a green sub-pixel, a blue sub-pixel and a red sub-pixel, and the left borders of the sub-pixels of the next row of pixel unit are aligned with the midpoints of the lower borders of the sub-pixels of the previous row of pixel unit. In embodiment (3), the sub-pixels of the previous row of pixel unit, from left to right, are a blue sub-pixel, a green sub-pixel and a red sub-pixel, the sub-pixels of the next row of pixel unit, from left to right, are a red sub-pixel, a blue sub-pixel and a green sub-pixel, and the left borders of the sub-pixels of the next row of pixel unit are aligned with the midpoints of the lower borders of the sub-pixels of the previous row of pixel unit. In embodiment (4), the sub-pixels of the previous row of pixel unit, from left to right, are a green sub-pixel, a blue sub-pixel and a red sub-pixel, the sub-pixels of the next row of pixel unit, from left to right, are a red sub-pixel, a green sub-pixel and a blue sub-pixel, and the left borders of the sub-pixels of the next row of pixel unit are aligned with the midpoints of the lower borders of the sub-pixels of the previous row of pixel unit. In embodiment (5), the sub-pixels of the previous row of pixel unit, from left to right, are a green sub-pixel, a red sub-pixel and a blue sub-pixel, the sub-pixel of the next row of pixel unit, from left to right, are a blue sub-pixel, a green sub-pixel and a red sub-pixel, and the left borders of the sub-pixels of the next row of pixel unit are aligned with the midpoints of the lower borders of the sub-pixels of the previous row of pixel unit. In embodiment (6), the sub-pixels of the previous row of pixel unit, from left to right, are a red sub-pixel, a green sub-pixel and a blue sub-pixel, the sub-pixels of the next row of pixel unit, from left to right, are a blue sub-pixel, a red sub-pixel and a green sub-pixel, and the left borders of the sub-pixels of the next row of pixel unit are aligned with the midpoints of the lower borders of the sub-pixels of the previous row of pixel unit. In embodiment (7), the sub-pixels of the previous row of pixel unit, from left to right, are a green sub-pixel, a red sub-pixel and a blue sub-pixel, the sub-pixels of the next row of pixel unit are a red sub-pixel, a blue sub-pixel and a green sub-pixel, and the left borders of the sub-pixels of the previous row of pixel unit, from left to right, are aligned with the midpoints of the upper borders of the sub-pixels of the next row of pixel unit. In embodiment (8), the sub-pixels of the previous row of pixel unit, from left to right, are a green sub-pixel, a blue sub-pixel and a red sub-pixel, the sub-pixels of the next row of pixel unit, from left to right, are a blue sub-pixel, a red sub-pixel and a green sub-pixel, and the left borders of the sub-pixels of the previous row of pixel unit are aligned with the midpoints of the upper borders of the sub-pixels of the next row of pixel unit. In embodiment (9), the sub-pixels of the previous row of pixel unit, from left to right, are a red sub-pixel, a blue sub-pixel and a green sub-pixel, the sub-pixels of the next row of pixel unit, from left to right, are a blue sub-pixel, a green sub-pixel and a red sub-pixel, and the left borders of the sub-pixels of the previous row of pixel unit are aligned with the midpoints of the upper borders of the sub-pixels of the next row of pixel unit. In embodiment (10), the sub-pixels of the previous row of pixel unit, from left to right, are a red sub-pixel, a green sub-pixel and a blue sub-pixel, the sub-pixels of the next row of pixel unit, from left to right, are a green sub-pixel, a blue sub-pixel and a red sub-pixel, and the left borders of the sub-pixels of the previous row of pixel unit are aligned with the midpoints of the upper borders of the sub-pixels of the next row of pixel unit. In embodiment (11) the sub-pixels of the previous row of pixel unit, from left to right, are a blue sub-pixel, a green sub-pixel and a red sub-pixel, the sub-pixels of the next row of pixel unit, from left to right, are a green sub-pixel, a red sub-pixel and a blue sub-pixel, and the left borders of the sub-pixels of the previous row of pixel unit are aligned with the midpoints of the upper borders of the sub-pixels of the next row of pixel unit. In embodiment (12), the sub-pixels of the previous row of pixel unit, from left to right, are a blue sub-pixel, a red sub-pixel and a green sub-pixel, the sub-pixels of the next row of pixel unit, from left to right, are a red sub-pixel, a green sub-pixel and a blue sub-pixel, and the left borders of the sub-pixels of the previous row of pixel unit are aligned with the midpoints of the upper borders of the sub-pixels of the next row of pixel unit.

Next, the method for driving a pixel array according to the embodiment of the present invention will be explained specifically with reference to FIG. 6 and FIG. 7. Particularly, the method of calculating the luminance value of each sub-pixel will be explained in detail.

Figures 6, 7:
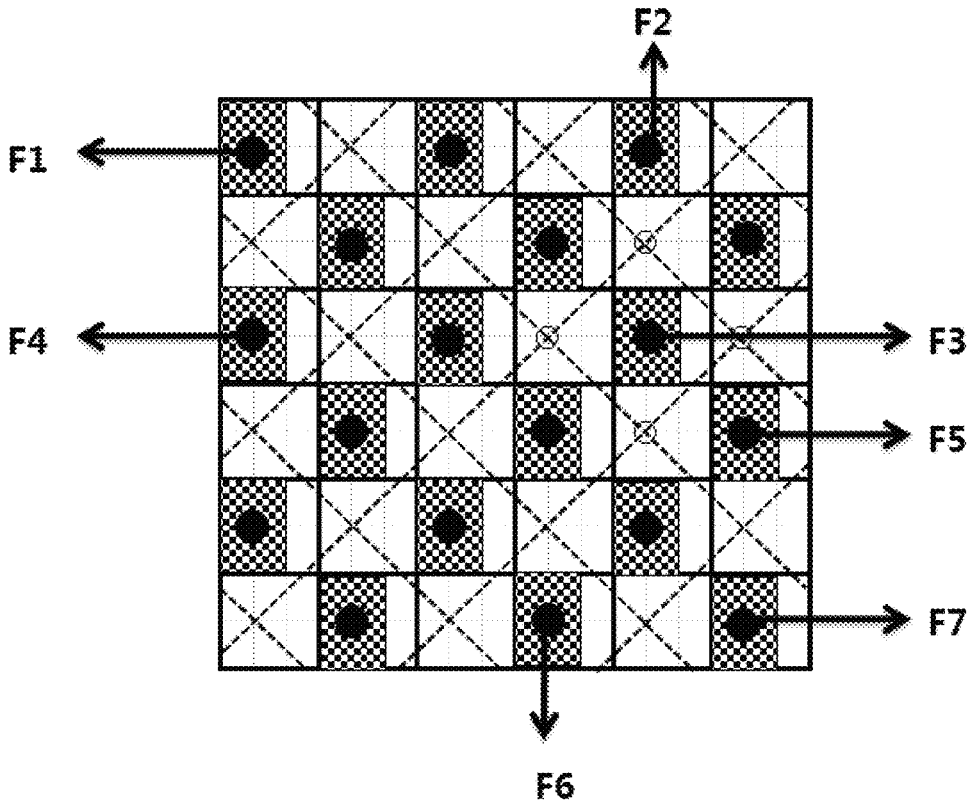
FIG. 6 is a schematic view for explaining a method for driving a pixel array according to an embodiment of the present invention.
FIG. 7 shows a matrix of ratios of overlapping areas of the theoretical pixel units in FIG. 6 with the diamond sampling areas for the sub-pixels and the areas of the diamond sampling areas.

In the example as shown in FIG. 6, each sub-pixel has an aspect ratio of 2:3, whereas each divided theoretical pixel unit has an aspect ratio of 1:1. Each theoretical pixel unit covers 1.5 sub-pixels laterally, i.e. every two theoretical pixel units adjacent laterally may cover three sub-pixels (i.e. one pixel unit). Consequently, a display effect that the lateral resolution is doubled can be achieved when the pixel array is driven using the method according to the embodiment of the present invention.

As shown in FIG. 6, between two adjacent rows, the borders of the sub-pixels are aligned. However, the present invention is not limited to this, instead, the sub-pixels can be arranged for example in the various arrangement manners as shown in FIG. 5.

In addition, in the example of FIG. 6, respective red sub-pixels are shown emphatically in the form of a checkerboard, while the blue and green sub-pixels are shown between two adjacent red sub-pixels in the horizontal direction in the form of blanks, so as to avoid any lack of clarity.

Firstly, the image to be displayed is divided into a plurality of theoretical pixel units based on a desired resolution, each theoretical pixel unit comprising a plurality of color components in the corresponding area of the image to be displayed. In other words, the luminance values of respective different color components (for example, a luminance value of the red component, a luminance value of the green component and a luminance value of the blue component) in each theoretical pixel unit are calculated based on the desired resolution through the image to be displayed.

Then, the luminance value of each sub-pixel of each pixel unit is calculated based on the color components of respective divided theoretical pixel units. Next, the red sub-pixel is taken as an example to explain the method of calculating the luminance value of each sub-pixel.

First, a diamond sampling area is divided for a sub-pixel to be calculated (e.g., the red sub-pixel F3), the center of the diamond sampling area is the center of this sub-pixel, moreover, the four vertexes of the diamond sampling area are midpoints of the connecting lines between the centers of adjacent sub-pixels (e.g., the red sub-pixel F2 above the red sub-pixel F3) in the same row or the same column and with the same color as this sub-pixel and the center of this sub-pixel. In FIG. 6, the four vertexes of the diamond sampling area for the red sub-pixel F3 are shown exemplarily in the form of small circles.

Secondly, the ratio of the overlapping area of each theoretical pixel unit with the diamond sampling area for this sub-pixel and the area of the diamond sampling area is calculated, as the area ratio of the theoretical pixel unit with respect to the diamond sampling area for this sub-pixel. For example, as shown in FIG. 6, the diamond sampling area for the red sub-pixel F3 may have overlapping portions with seven theoretical pixel units, which are theoretical pixel units at upper left, lower left, above, below, at left side and at right side of the red sub-pixel F3 as well as the theoretical pixel unit covering the red sub-pixel F3 respectively. FIG. 7 shows the area ratios of respective theoretical pixel units with respect to the diamond sampling area for the red sub-pixel F3 in the form of matrix. The area ratio matrix of respective red sub-pixels F1 to F7 can be calculated in the same way, as shown in FIG. 7. It should be noted that when a sub-pixel is at the edge portion or the corner portion of the pixel array, the diamond sampling area for the sub-pixel is not a complete diamond, the area ratio of the theoretical pixel unit with respect to the diamond sampling area should be calculated using the actual area of the diamond sampling area (rather than the complete diamond area). In addition, in the respective area ratio matrixes as shown in FIG. 7, rounding has been performed to the respective calculated area ratios.

Then, an area ratio of each theoretical pixel unit with respect to the diamond sampling area for the sub-pixel is used to multiply a color component of corresponding theoretical pixel unit with the same color as the sub-pixel, and a summation of respective products is taken as a luminance value of the sub-pixel. For example, when the luminance value of the red sub-pixel F3 is calculated, the red component (i.e., the luminance value of the red component) of the theoretical pixel unit at the upper left of the red sub-pixel F3 is multiplied by an area ratio of 0.01, the red component of the theoretical pixel unit above the red sub-pixel F3 is multiplied by an area ratio of 0.12, the red component of the theoretical pixel unit at the left side of the red sub-pixel F3 is multiplied by an area ratio of 0.21, the red component of the theoretical pixel unit at the right side of the red sub-pixel F3 is multiplied by an area ratio of 0.05, the red component of the theoretical pixel unit at lower left of the red sub-pixel F3 is multiplied by an area ratio of 0.01, the red component of the theoretical pixel unit below the red sub-pixel F3 is multiplied by an area ratio of 0.12, and the red component of the theoretical pixel unit covering the red sub-pixel F3 is multiplied by an area ratio of 0.48, so as to obtain respective products, and a summation of the respective products is taken as the luminance value of the red sub-pixel F3.

Figure 3A:
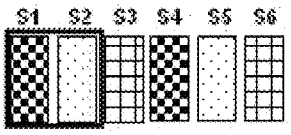
FIGS. 3*a* to 3*c* are schematic views of pixel units in a pixel array according to another embodiment of the present invention.
Figure 3B:
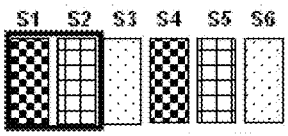
Figure 3C:
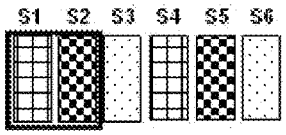
Figure 4D:
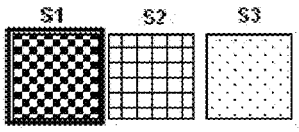
Figure 4D:
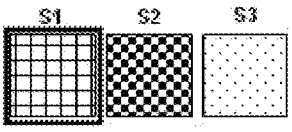
Figure 4D:
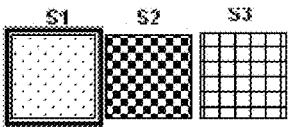
Figure 4D:
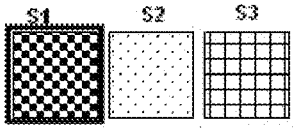
Figure 4E:
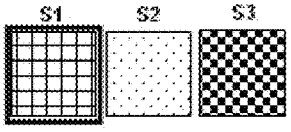
Figure 4F:
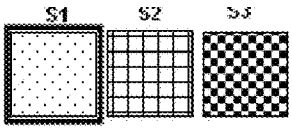

FIGS. 3*a* to 3*c* are schematic views of pixel units in a pixel array according to another embodiment of the present invention. As shown in FIG. 3*a* to FIG. 3*c*, each sub-pixel may have an aspect ratio of 1:2. Each theoretical pixel unit may cover two sub-pixels in the horizontal direction, so every three laterally adjacent theoretical pixel units may cover six sub-pixels, i.e., covering two pixel units. Consequently, when the pixel array is driven using the method according to the embodiment of the present invention, the display effect that the lateral resolution is increased by a factor of 0.5 can be achieved.

FIGS. 4*a* to 4*f* are schematic views of pixel units in a pixel array according to a further embodiment of the present invention. As shown in FIG. 4*a* to FIG. 4*f*, each sub-pixel may have an aspect ratio of 1:1, each theoretical pixel unit covers one sub-pixel in the horizontal direction, while every three laterally adjacent theoretical pixel units may cover three sub-pixels, i.e., covering one pixel unit. Consequently, when this pixel array is driven using the method according to the embodiment of the present invention, the display effect that the lateral resolution is increased to 3 times can be achieved.

Although a pixel array comprising sub-pixels of three colors is explained above, the skilled person in the art should understand that the pixel array may comprise sub-pixels of four colors (e.g., red, green, blue and white).

It could be understood that the above embodiments are only exemplary implementations used for explaining the principle of the present invention, rather not intended to limit the present invention. For the ordinary skilled person in the art, various modifications and variations can be made without departing from the spirit and essence of the present invention, such modifications and variations should also be regarded within the scope of the present invention.

What is claimed is:

1. A method for driving a pixel array in a display panel, the pixel array comprising a plurality of pixel units, each pixel unit comprising a plurality of sub-pixels of different colors, each sub-pixel having an aspect ratio from 1:2 to 1:1, the method comprising steps of:

dividing an image to be displayed on the display panel into a plurality of theoretical pixel units based on a desired resolution, thereby obtaining a pixel pattern of the image to be displayed, each theoretical pixel unit comprising a plurality of color components and having an aspect ratio of 1:1, thereby the theoretical pixel unit being an area unit of the image to be displayed corresponding to the desired resolution, the area of each theoretical pixel unit being smaller than the area of each pixel unit in the pixel array; and calculating a luminance value of each sub-pixel of each pixel-unit based on the color components of respective divided theoretical pixel units, comprising sub-steps of:

dividing a diamond sampling area for each sub-pixel in the pixel array, a center of the diamond sampling area being a center of the sub-pixel, and four vertexes of the diamond sampling area being midpoints of connecting lines between centers of adjacent sub-pixels in the same row or the same column and with the same color as the sub-pixel and the center of the sub-pixel respectively;

calculating a ratio of an overlapping area of each theoretical pixel unit with the diamond sampling area for the sub-pixel and the area of the diamond sampling area, as an area ratio of the theoretical pixel unit with respect to the diamond sampling area for the sub-pixel; and using an area ratio of each theoretical pixel unit with respect to the diamond sampling area for the sub-pixel to multiply a color component of the theoretical pixel unit with the same color as the sub-pixel, and taking a summation of respective products to set the luminance value of the sub-pixel.

2. The method for driving a pixel array according to claim 1, wherein the pixel unit comprises three sub-pixels of different colors, each sub-pixel having an aspect ratio of 2:3.

3. The method for driving a pixel array according to claim 2, wherein each theoretical pixel unit of the plurality of theoretical pixel units has an aspect ratio of 1:1.

4. The method for driving a pixel array according to claim 3, wherein the three sub-pixels of different colors are a red sub-pixel, a green sub-pixel and a blue sub-pixel respectively.

5. The method for driving a pixel array according to claim 2, wherein the pixel array comprises a plurality of pixel groups, each pixel group comprising two adjacent pixel units located in a same column, left borders of sub-pixels of a next row of pixel unit being aligned with midpoints of lower borders of sub-pixels of a previous row of pixel unit, or left borders of sub-pixels of the previous row of pixel unit being aligned with midpoints of upper borders of sub-pixels of the next row of pixel unit.

6. The method for driving a pixel array according to claim 5, wherein the pixel groups are arranged in one or more of the following arrangement manners:

the sub-pixels of the previous row of pixel unit being, from left to right, a red sub-pixel, a blue sub-pixel and a green sub-pixel, the sub-pixels of the next row of pixel unit being, from left to right, a green sub-pixel, a red sub-pixel and a blue sub-pixel, and the left borders of the sub-pixels of the next row of pixel unit being aligned with the midpoints of the lower borders of the sub-pixels of the previous row of pixel unit;

the sub-pixels of the previous row of pixel unit being, from left to right, a blue sub-pixel, a red sub-pixel, a green sub-pixel, the sub-pixel of the next row of pixel unit being, from left to right, a green sub-pixel, a blue sub-pixel and a red sub-pixel, and the left borders of the sub-pixels of the next row of pixel unit being aligned with the midpoints of the lower borders of the sub-pixels of the previous row of pixel unit;

the sub-pixels of the previous row of pixel unit being, from left to right, a blue sub-pixel, a green sub-pixel and a red sub-pixel, the sub-pixels of the next row of pixel unit being, from left to right, a red sub-pixel, a blue sub-pixel and a green sub-pixel, and the left borders of the sub-pixels of the next row of pixel unit being aligned with the midpoints of the lower borders of the sub-pixels of the previous row of pixel unit;

the sub-pixels of the previous row of pixel unit being, from left to right, a green sub-pixel, a blue sub-pixel and a red sub-pixel, the sub-pixels of the next row of pixel unit being, from left to right, a red sub-pixel, a green sub-pixel and a blue sub-pixel, and the left borders of the sub-pixels of the next row of pixel unit being aligned with the midpoints of the lower borders of the sub-pixels of the previous row of pixel unit;

the sub-pixels of the previous row of pixel unit being, from left to right, a green sub-pixel, a red sub-pixel and a blue sub-pixel, the sub-pixel of the next row of pixel unit being, from left to right, a blue sub-pixel, a green sub-pixel and a red sub-pixel, and the left borders of the sub-pixels of the next row of pixel unit being aligned with the midpoints of the lower borders of the sub-pixels of the previous row of pixel unit;

the sub-pixels of the previous row of pixel unit being, from left to right, a red sub-pixel, a green sub-pixel and a blue sub-pixel, the sub-pixels of the next row of pixel unit being, from left to right, a blue sub-pixel, a red sub-pixel and a green sub-pixel, and the left borders of the sub-pixels of the next row of pixel unit being aligned with the midpoints of the lower borders of the sub-pixels of the previous row of pixel unit;

the sub-pixels of the previous row of pixel unit being, from left to right, a green sub-pixel, a red sub-pixel and a blue sub-pixel, the sub-pixels of the next row of pixel unit being, from left to right, a red sub-pixel, a blue sub-pixel and a green sub-pixel, and the left borders of the sub-pixels of the previous row of pixel unit being aligned with the midpoints of the upper borders of the sub-pixels of the next row of pixel unit;

the sub-pixels of the previous row of pixel unit being a green sub-pixel, a blue sub-pixel and a red sub-pixel, the sub-pixels of the next row of pixel unit being, from left to right, a blue sub-pixel, a red sub-pixel and a green sub-pixel, and the left borders of the sub-pixels of the previous row of pixel unit being, from left to right, aligned with the midpoints of the upper borders of the sub-pixels of the next row of pixel unit;

the sub-pixels of the previous row of pixel unit being, from left to right, a red sub-pixel, a blue sub-pixel and a green sub-pixel, the sub-pixels of the next row of pixel unit being, from left to right, a blue sub-pixel, a green sub-pixel and a red sub-pixel, and the left borders of the sub-pixels of the previous row of pixel unit being aligned with the midpoints of the upper borders of the sub-pixels of the next row of pixel unit;

the sub-pixels of the previous row of pixel unit being, from left to right, a red sub-pixel, a green sub-pixel and a blue sub-pixel, the sub-pixels of the next row of pixel unit being, from left to right, a green sub-pixel, a blue sub-pixel and a red sub-pixel, and the left borders of the sub-pixels of the previous row of pixel unit being aligned with the midpoints of the upper borders of the sub-pixels of the next row of pixel unit;

the sub-pixels of the previous row of pixel unit being, from left to right, a blue sub-pixel, a green sub-pixel and a red sub-pixel, the sub-pixels of the next row of pixel unit being, from left to right, a green sub-pixel, a red sub-pixel and a blue sub-pixel, and the left borders of the sub-pixels of the previous row of pixel unit being aligned with the midpoints of the upper borders of the sub-pixels of the next row of pixel unit; or the sub-pixels of the previous row of pixel unit being, from left to right, a blue sub-pixel, a red sub-pixel and a green sub-pixel, the sub-pixels of the next row of pixel unit being, from left to right, a red sub-pixel, a green sub-pixel and a blue sub-pixel, and the left borders of the sub-pixels of the previous row of pixel unit being aligned with the midpoints of the upper borders of the sub-pixels of the next row of pixel unit.

7. The method for driving a pixel array according to claim 1, wherein each sub-pixel has an aspect ratio of 1:2.

8. The method for driving a pixel array according to claim 1, wherein each sub-pixel has an aspect ratio of 1:1.

9. The method for driving a pixel array according to claim 1, wherein the pixel unit comprises four sub-pixels of different colors.

10. The method for driving a pixel array according to claim 9, wherein the four sub-pixels are a red sub-pixel, a green sub-pixel, a blue sub-pixel and a white sub-pixel respectively.

* * * * *